United States Patent [19]

Pujari et al.

[11] 4,330,028

[45] May 18, 1982

[54] SEAL COLUMN APPARATUS AND METHOD

[75] Inventors: Vimal K. Pujari; Jackson P. Trentelman, both of Corning, N.Y.

[73] Assignee: Corning Glass Works, Corning, N.Y.

[21] Appl. No.: 205,774

[22] Filed: Nov. 10, 1980

[51] Int. Cl.[3] ..... F28D 19/00

[52] U.S. Cl. ..... 165/1; 165/9; 165/10

[58] Field of Search ..... 165/9, 10, 1

[56] References Cited

U.S. PATENT DOCUMENTS

| | | | |
|---|---|---|---|
| 3,270,803 | 9/1966 | Hazzard | 165/9 |
| 3,273,904 | 9/1966 | Chapman et al. | 165/9 X |
| 3,372,735 | 3/1968 | Meijer | 165/10 X |
| 4,040,474 | 8/1977 | Stroom et al. | 165/9 |

*Primary Examiner*—Albert W. Davis
*Attorney, Agent, or Firm*—Richard N. Wardell

[57] ABSTRACT

An improved seal column design for use in counterflow heat exchanger systems having a centrally supported rotary heat exchanger or heat recovery wheel having an integral strengthened central hub. According to the invention, the edges formed between the end wall of each seal column juxtaposed an annular face of the wheel and the side walls of the column exposed to and separating the fluid flows are straight and parallel to one another and evenly spaced, at their point of closest approach, between one-half inch (1.27 cm) and one and one-half inches (3.81 cm) and preferably one inch (2.54 cm) beyond the outer circumference of the hub. Also, the side walls of the columns are straight and parallel to one another in the vicinity of the end wall.

15 Claims, 2 Drawing Figures

SEAL COLUMN APPARATUS AND METHOD

BACKGROUND OF THE INVENTION

This invention relates to counterflow heat exchanger systems using a centrally supported heat recovery wheel made from ceramic or other suitable materials, and in particular, to the seal columns used to separate flows of hot and cold fluids passing through the wheel in such systems.

Counterflow heat exchanger systems are being used in an increasing variety of applications to recover thermal energy from relatively hot fluids, generally exhaust gases. In most such systems, a rotary heat exchanger (also known as heat recovery wheel) is supported and driven by a central metal shaft assembly. The wheel consists of a matrix having a plurality of apertures or open-ended, hollow cells extending through it, and is usually provided with a strengthened nonapertured central hub. Ceramic and glass-ceramic materials have been found to be most suited for the formation of such wheels although it is conceivable that glass, cermet or other ceramic based materials could be employed if compatible (e.g. sufficient strength, chemical resistance, low thermal expansion, refractoriness, etc.) with the service conditions encountered.

The system operates by continually rotating the wheel through simultaneous opposing flows of relatively hot and cold gases which pass axially through opposing halves of the wheel. Thermal energy is absorbed from the hot gas by the thin walls forming the open cells of the matrix of the wheel and given up during the other half of its rotational cycle to the relatively cold gas flowing through the opposite half of the system. The hot and cold fluid flows are separated from one another at the annular faces of the wheel by seal columns extending entirely across each of the two annular faces of the wheel and away therefrom. The efficiency of thermal recovery of the system is maximized by exposing the wheel to the hot fluid at the highest temperature the wheel can withstand without failure. Passing the fluids in opposite directions through the wheel also increases the system's efficiency and reduces thermal shock. Ceramic heat recovery wheels have been designed for and operated in gas flows having temperatures of approximately 820° C. and above.

The thermal shock resulting from instantly exposing the wheel to hot gases at such elevated temperatures and continued rotation of the wheel through the hot and cold gases are the predominant sources of wheel related failures. The metal shaft assemblies, typically steel, generally used to support and drive such wheels cannot withstand these maximum temperatures and so must be protected. The ceramic wheels themselves are subject to a combination of mechanically and thermally induced stresses, the latter being more difficult to predict and control during operation. Thermally induced radial stresses in the wheel are directly proportional to a number of factors including the magnitudes of the coefficient of thermal expansion and the elastic moduli of the material, of the maximum radial temperature difference across the face of the wheel and of the local slope of this temperature difference. Differing radial temperatures are created in the wheel during operation by several factors including the need to maintain the temperature of the metal shaft below that of the hot fluids and the presence of the seal columns which screen portions of the wheel from the direct fluid flows. Although the end walls of the seal columns are positioned as close as possible to the annular faces of the wheel so as to minimize the cross-flow of gases, the area of the wheel shielded by the seal column is still heated by convection of hot fluids through the small gap which does exist between the annular face of the wheel and the face of the adjoining seal column. To a lesser extent the area covered by the seal columns is also heated by conduction from the outer portion of the wheel directly exposed to the hot fluid. Cooling similarly occurs on the opposite half of the wheel.

Ideally, one would like to maximize the thermal efficiency of the system and minimize radial temperature differences and their localized gradients by reducing the width of the seal column to less than that of the diameter of the central hub, thus allowing each face of the wheel to run at a uniform temperature. Doing this, however, heats the hub and metal shaft assembly unduly since it is now receiving direct impingement of the hot gas and because the reduced width of the seal column increases convection heating by the cross-flowing fluids. This creates two major problems. Typically the hub will be formed from the same material as the matrix. Being solid to withstand the mechanical loads present near the center of the wheel, it has a higher modulus and is relatively more sensitive to thermal shock than is the surrounding matrix. Thus the hub will fail if exposed to high temperature gas flows which the matrix can withstand. This in turn limits the maximum operating temperature of the system to the critical temperature of the hub. Secondly, if overheated, the metal shaft assembly will expand excessively leading to such problems as misalignment of the shaft with respect to the wheel, a reduction in the clamping forces between the metal hub assembly and the wheel and overloading of the bearings supporting the shaft, any of which can lead to ultimate failure of the heat exchanger. A seal column significantly wider than the hub more efficiently cools the hub and shaft assembly under the seal column, but increases the maximum radial temperature difference of the wheel, decreases the relative heat exchange efficiency of the system and increases the pressure drop across and thus the mechanical stresses upon the wheel. Moreover, any lack of symmetry among the edges of the seal columns where they meet the annular faces of the wheel creates uneven heating and cooling and therefore increased localized stresses in particular areas of the wheel. The net result of each of these factors is to reduce the maximun potential temperature at which the wheel can be operated and therefore the efficiency of the system.

It is believed that the criticality of these relationships have not been heretofore perceived. Previous seal columns used with rotary wheel heat recovery systems were typically designed to operate a maximum temperatures of approximately 820° Centigrade (1500° Fahrenheit) with wheels formed from ceramic based materials having coefficients of thermal expansion of about $10\times10^{-7}$/°Centigrade or less over the range 0° to 1000° Centigrade. Such columns were found to be a significant cause of failure in such wheels when operated above 820° C. Other wheels formed from materials having coefficients of thermal expansion greater than $10\times10^{-7}$/°Centigrade in the range 0° to 1000° Centigrade also suffers similar failures when attempts were made to operate them at maximum temperatures of 820° C. or above.

SUMMARY OF THE INVENTION

It is an object of the invention to provide an improved design for a seal column which reduces the magnitude of peak thermal stresses occurring locally in a rotary heat recovery wheel used with such columns.

It is an object of the invention to provide an improved design for a seal column which reduces the magnitude of average thermal stresses occurring in a rotary heat recovery wheel used with such columns.

It is another object of the invention to provide an improved design for a seal column to be used with heat recovery wheels made from materials having thermal coefficients of expansion greater than $10\times10^{-7}$/°Centigrade in the range of 0° to 1000° Centigrade.

In a counterflow heat exchanger system utilizing a centrally supported heat recovery wheel, seal columns are provided to separate the hot and cold gas passing in opposite directions through the system and wheel. According to the invention, an end wall of a seal column is positioned adjacent each of the two annular faces of the wheel sufficiently close as manufacturing tolerances will allow taking into account the expansion of the wheel. The pair of outer edges of each seal column end formed by the junction of the seal column end wall with its side walls exposed to and separating the fluid flows are symmetric to one another in form and position with respect to a first plane passing axially through the center of the rotary wheel and between the side walls of each column, and a second plane passing between the faces of the wheel and perpendicular to its central rotational axis, and are positioned at a uniform distance beyond the outer circumference of the integral central hub of such wheel which minimizes the maximum radial temperature difference experienced by the wheel while preventing overheating of the central hub and shaft assembly. The edges are preferably straight and parallel to one another, as are the sidewalls separating the fluid flows so as to direct the momentum of the fluid axially through the wheel. It has been found that in a typical industrial heat recovery systems the edges of the preferred seal columns should extend preferably about one inch (2.54 cm) but not less than about one-half inch (1.27 cm) or more than about one and one-half inches (3.81 cm) beyond the outer circumference of the central integral hub of the wheel, measured perpendicularly to the wheel's rotational axis at the point of closest approach of the edges to the circumference of the wheel's central integral hub.

BRIEF DESCRIPTION OF THE DRAWINGS

The invention will now be described with reference to the accompanying drawings in which.

DESCRIPTION OF THE PREFERRED EMBODIMENT

Figure 1:
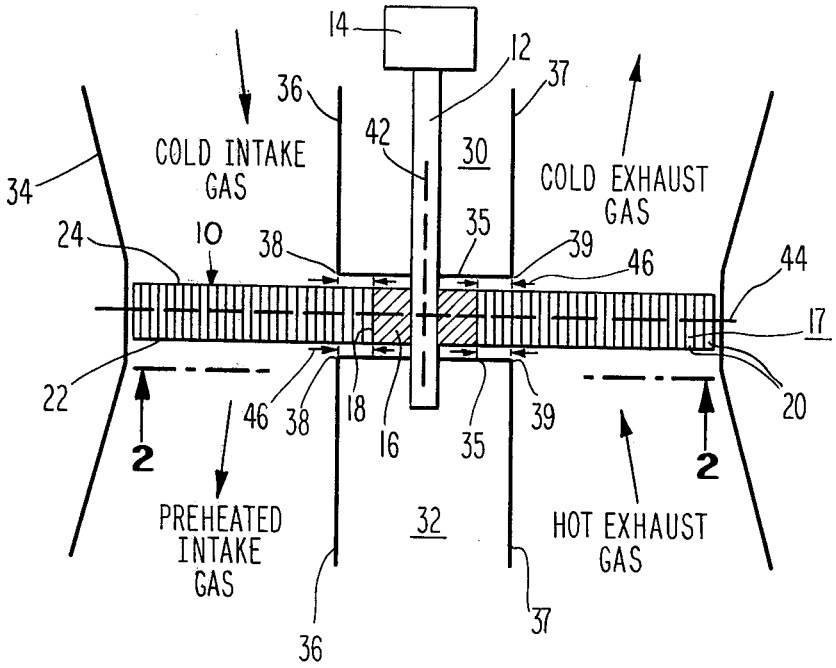
FIG. 1 is a plan view of the components associated with a heat recovery wheel, partially sectioned through its center, in a typical counterflow heat exchanger system utilizing seal columns according to the invention.

Referring now to FIG. 1, there is depicted a couterflow heat exchanger system utilizing the preferred embodiment of the invention. The system comprises a wheel 10 supported on a shaft assembly 12, typically steel, passing through its central axis. The shaft assembly 12 may be rotated by a motor 14 or other suitable means (not depicted) or the wheel may, in the alternative, be driven at its circumference by other means, such as a ring gear (also not shown). The wheel 10 has been sectioned through its central axis to reveal an integral central hub 16 of solid material surrounded by a honeycombed matrix 17. The matrix 17 consists of a plurality of open-ended, hollow, cells 20 formed from thin walls of a ceramic-based material or other material having a low thermal coefficient of expansion and otherwise suitable for the service conditions to be encountered. The central hub 16 is also made from a ceramic-based or other suitable material having a coefficient of thermal expansion identical or very similar to the material comprising the matrix 17 so as to minimize stresses between the hub and matrix induced by thermal expansion. The cells 20 provide passages for gases to flow in an axial direction through the wheel 10. The open ends of the cells 20 form the wheel's first and second annular faces 22 and 24, respectively, which typically are planar and parallel to one another. The system arrangement allows the annular face exposed to the highest fluid temperature (the first annular face 22 in FIG. 1) to be operated at a higher average temperature than the opposite annular face. Hereinafter this shall be referred to as the "hot face" of the heat recovery wheel. The central hub 16 has an outer circumference 18, typically of uniform diameter at the annular faces 22 and 24 of the wheel 10. The opposing fluid flows are separated from one another by seal columns 30 and 32. Outer walls 34 surround the wheel 10 and seal columns 30 and 32 and conduct the hot and cold fluids up to and away from the wheel 10. It should be noted that although the shaft assembly 12 is depicted in FIG. 1 to extend through seal column 32 and into seal column 30, in some systems the shaft assembly 12 does not extend beyond the second open annular face 24 or, if so, does not contact the second seal column 30. Although not depicted herein, suitable shaft assemblies for centrally driven heat recovery wheels are disclosed in among others, U.S. Pat. No. 3,978,914 to Phillips and in copending applications Ser. Nos. 205,779 and 205,780 filed Nov. 10, 1980, the latter applications both being assigned to the assignee of this application, and all hereby being incorporated by reference herein.

Each seal column consists of an end wall 35 and side walls 36 and 37 which separate the opposing fluid flows. Edges 38 and 39 are formed at the junction of the end walls 35 and each side wall 36 and 37, respectively. If the junction of an end wall and side wall is in the form of a radius, edge shall be understood to refer to the seal column wall at the center of the arc comprising the radius. In the preferred embodiment the end walls 35 are positioned parallel to, and spaced as close as manufacturing and assembly tolerances allow (about 1/16 to ⅛ of one inch or 1.6 to 3.2 mm, cold measurement) to the adjacent open annular face 22 or 24 of the rotary wheel 10. Both end walls 35 are made sufficiently wide so that their edges 38 and 39 lie beyond the outer circumference 18 of the central hub 16 a distance sufficient to prevent overheating of the hub and shaft assembly, especially in the gap between the hot annular face 22 and the opposing end wall 35 of the seal column 32, but not so great as to prevent the hub 16 and or shaft assembly 14 from being sufficiently heated by conduction and/or convection so as to lower the maximum radial temperature difference of the wheel below the level where wheel failure will occur.

According to the invention, the edges 38 and 39 are essentially symmetric in shape and position with respect to a first plane 42 passing axially through the center of the rotational axis of the wheel 10 and the center of the columns 30 and 32 and a second plane 44 between and equidistant from the open annular faces 22 and 24 of the wheel 10. In the preferred embodiment, the edges 38 and 39 are essentially straight and parallel to one another. It is also preferred that the side walls 36 and 37 be straight and parallel to one another and perpendicular to the end walls 35 in the vicinity of the end walls 35. Applicants have employed side walls extending parallel to one another and perpendicular to an annular face for as short a distance as approximately six inches (15.24 cm) but suggest extending the side walls perpendicularly to an annular face and parallel to one another for at least one foot (30.5 cm) or more, if possible, so as to direct the momentum of the gases in an essentially axial direction with respect to the wheel. Sets of arrows 46 indicate the distance in a direction perpendicular to the first plane plane 42 at the point of closest approach between each edge 38 and 39 and the nearest portion of the outer circumference 18 of the central hub 16 where that surface meets the open annular faces 22 and 24 of the wheel 10.

Figure 2:
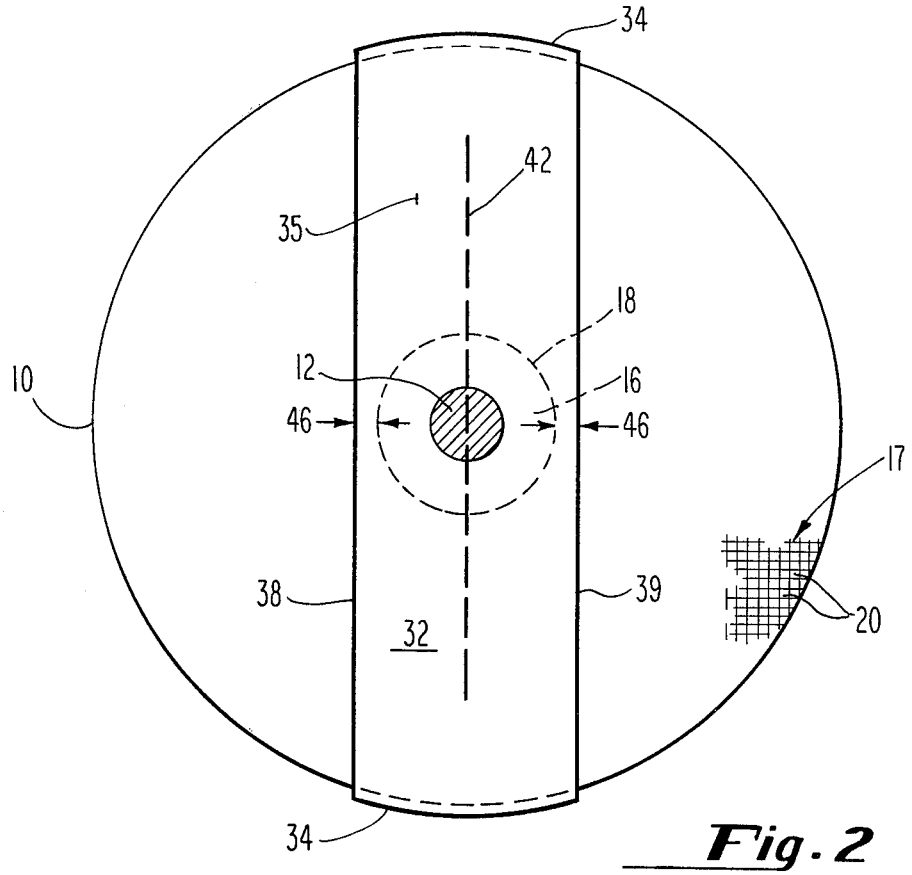
FIG. 2 is a sectional view taken along line 2—2 of FIG. 1.

FIG. 2 is a frontal view of the first annular or "hot" face 22 of the wheel 10 and section of the seal column 32 adjoining it. In accordance with the preferred embodiment, the edges 38 and 39 are straight and parallel. The shortest distances perpendicular to the first plane 42 between each edge 38 and 39 and the outer circumference 18 of the central hub 16 where it meets the first annular surface 22 of the wheel 10 are again indicated by the sets of arrows 46 and, again according to the invention, are equal and of sufficient magnitude to essentially minimize the maximum radial temperature difference occurring between the central hub and heated matrix of the wheel while preventing overheating of the central hub 16 and shaft assembly 12. A mirror view exists from the opposite side of the wheel 10 between its second open annular face 24 and the seal column 30. Consequently, if the diameter of the outer circumference 18 of the central hub 16 is uniform, as is typical, planes formed between the edges 38 and between the edges 39 are parallel to and equidistant from the first plane 42 passing through the central axis of the wheel 10.

Tests of various seal column geometries and spacing have been undertaken to demonstrate the improvement afforded by the described preferred embodiment of the invention. Several twenty-eight inch (71 cm) diameter wheels produced from materials having coefficients of thermal expansion of between approximately 10 and $30\times10^{-7}$/°Centigrade, over the range 0° to 1000° Centigrade were constructed with central hubs of solid material having outer diameters of four or six inches (10.2 or 15.2 cm). The end walls of the seal columns were positioned approximately one-sixteenth of an inch (1.6 mm) (cold measurement) from the opposing annular faces of the wheel. The wheels were rotated at a constant rate of 20 rpm while being tested. Gas flows of approximately 1500 standard cubic feet per minute were maintained through each half of the wheel resulting in a pressure drop of approximately six to ten inches (15.2 to 30.5 cm) of water. It was observed that by using seal columns having straight, parallel edges extending approximately one-inch (2.54 cm) beyond the outer circumference of their central hubs such wheels could be operated at maximum temperatures of approximately 925° Centigrade with only minor spalling or no damage whereas similar wheels operated with columns having straight edges positioned either coincident or two inches (5.1 cm) beyond the outer circumference of their central hub failed at or below approximately 820° Centigrade under similar heating cycles. Also such wheels could be operated at higher temperatures, without failure, than could similar wheels using previously available seal columns designed for use with such wheels or another seal column designed to create a uniform temperature gradient (slope of the temperature distribution curve) across the half of the wheel exposed to the hot fluid flow. At least one wheel formed from cellular segments cemented together in accordance with the methods disclosed in copending applications Ser. Nos. 205,775 and 205,776 filed Nov. 10, 1980, both assigned to the assignee of this application, and incorporated by reference herein, experienced minor cracking but did not fail when tested at a temperature above 1000° Centigrade. Observations further lead applicants to believe that seal column edges spaced equally between approximately one-half inch (1.27 cm) and one and one-half inches (3.81 cm) from the outer circumference of the central hub at their point of closest approach will also provide improved stress reduction over previously known seal columns.

Commonly, the central hub of a heat recovery wheel is solid as is the hub 16 depicted in FIG. 1. It is possible to fabricate a heat recovery wheel entirely of honeycomb matrix. In such wheels, the honeycomb material around the wheel's central axis is generally denser, having thicker cell walls or a greater number of cells per unit area or both than the majority of the matrix used in the remainder of the wheel. Such denser matrix material can be considered to be equivalent to the solid central hub depicted in FIG. 1 for the purposes of this invention.

It is further expected that where a heat recovery wheel is provided with a central hub, the outer circumferences of that hub where it emerges on either annular face of the wheel will be of identical diameters. If the diameters of these outer circumferences are unequal, it is preferred that the edges of the seal columns be positioned approximately one-half inch (1.27 cm) to one and one-half inches (3.81 cm) beyond the edges of the outer circumference of the hub on the resulting hot annular face of the wheel, such as is the first annular face 22 of the wheel 10 in the system depicted in FIG. 1.

Although the preferred embodiment of the invention has been shown and described, it will be understood that the appended claims are intended to cover all embodiments and modifications which fall within the true spirit and scope of the invention.

We claim:

1. In a counterflow heat exchanger system having a heat recovery wheel with an integral central hub and two opposing annular faces and supported on a shaft assembly passing through a central axis thereof, a pair of opposing seal columns positioned adjacent said two opposing annular faces, each of said seal columns comprising:

a pair of side walls exposed to and separating opposing fluid flows; and an end wall extending between said side walls juxtaposed to one of said annular faces opposite said central hubs, each of said pair of sidewalls terminating in an edge at said end wall so as to form a pair of opposing edges, said edges all lying between approximately one-half inch (1.27 cm) and one and one-half inches (4.81 cm) beyond the outer circumference of said central hub, when measured perpendicularly to said central axis at the point of closest approach of each of said edges to said outer circumference.

2. The system described in claim 1 wherein said edges of each of said seal columns are symmetric with respect to a plane passing through the center of each of said seal columns and the axial center of said wheel and with respect to a plane passing between said annular faces of said wheel.

3. The system described in claim 2 wherein said opposing edges are straight and parallel to one another.

4. The system described in claims 1 or 3 wherein said edges all lie approximately one inch (2.54 cm) beyond the outer circumference of said hub.

5. The system described in claim 3, wherein said pair of side walls are straight and parallel to one another in the vicinity of said end wall.

6. The system described in claim 1 wherein said wheel is formed from a material having a maximum coefficient of thermal expansion greater than $10\times10^{-7}$/°Centigrade over the range 0° to 1000° Centigrade.

7. The system described in claim 1 wherein said wheel is formed from a material having a maximum coefficient of thermal expansion approximately $18\times10^{-7}$/°Centigrade or more over the range 0° to 1000° Centigrade.

8. The system described in claim 6 wherein said maximum coefficient of coefficient of thermal expansion is also less than $30\times10^{-7}$/°Centigrade over the range 0° to 1000° Centigrade.

9. The system described in claim 1 wherein said central hub has an outer diameter approximately four inches (10.2 cm) or more.

10. The system described in claim 4 wherein said central hub has an outer diameter approximately six inches (15.2 cm) or less.

11. The system described in claim 1 wherein said wheel is exposed to gases having a temperature in excess of 900° Centigrade.

12. The system described in claim 1 wherein said wheel is formed from a ceramic based material.

13. In a counterflow heat exchanger system having a heat recovery wheel with an integral central hub and two opposing annular faces and supported on a shaft assembly passing through a central axis thereof, a pair of opposing seal columns positioned adjacent said two opposing annular faces, each of said seal columns comprising:

a pair of side walls exposed to and separating opposing flows of relatively hot and cool fluids; and an end wall extending between said side walls juxtaposed to one of said annular faces opposite said central hub and being sufficiently wider between said side walls than the diameter of said hub to maximize the temperature difference between said hot and cool fluids which said wheel can withstand by substantially minimizing the maximum radial temperature difference occurring across said annular faces while preventing the failure of said central hub or said shaft assembly from overheating during operation of the system.

14. A method of operating a counterflow heat exchanger comprising a heat recovery wheel with an integral central hub and two opposing annular faces and supported on a shaft assembly passing through the central axis thereof, a pair of opposing seal columns positioned adjacent said opposing annular faces, said method comprising the following steps:

rotating said wheel and said shaft about said axis;

flowing relatively hot gases in one direction through said wheel between said annular faces on one side of said axis outwardly from said central hub;

flowing relatively cool gases in the opposite direction through said wheel between said annular faces on the opposite side of said axis outwardly from said central hub; and substantially blocking the flow of gases with said seal columns which form sealing zones extending diametrally across said faces and which are wider than the diameter of said hub so as to maximize the temperature difference between said hot and cool gases which said wheel can withstand by substantially minimizing the maximum radial temperature difference occuring across said annular faces while preventing the failure of said central hub or said shaft assembly from overheating during operation of the system.

15. The method of claim 14 wherein the gases are substantially blocked from flowing through said wheel in a vicinity not less than approximately ½ inch (1.27 cm) beyond said hub and not more than approximately 1½ inches (4.8 cm) beyond said hub.

* * * * *